US011515613B2

(12) United States Patent
Huang et al.

(10) Patent No.: US 11,515,613 B2
(45) Date of Patent: Nov. 29, 2022

(54) WIRELESS TRANSMISSION DEVICE AND BENDABLE ANTENNA THEREOF

(71) Applicant: Wistron NeWeb Corp., Hsinchu (TW)

(72) Inventors: Tzu-Heng Huang, Hsinchu (TW); Chun-Yu Lee, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 18 days.

(21) Appl. No.: 17/169,792

(22) Filed: Feb. 8, 2021

(65) Prior Publication Data

US 2021/0376442 A1 Dec. 2, 2021

(30) Foreign Application Priority Data

Jun. 1, 2020 (TW) ..... 109118265

(51) Int. Cl.
*H01Q 1/40* (2006.01)
*H01Q 11/04* (2006.01)
*H01Q 1/08* (2006.01)

(52) U.S. Cl.
CPC ..... *H01Q 1/084* (2013.01); *H01Q 1/40* (2013.01); *H01Q 11/04* (2013.01)

(58) Field of Classification Search
CPC ..... H01Q 1/084; H01Q 1/40; H01Q 11/04; H01Q 1/085; H01R 13/5208; H01R 13/5205
USPC ..... 343/702
See application file for complete search history.

(56) References Cited

U.S. PATENT DOCUMENTS 3,567,843 A * 3/1971 Collins ..... H02G 3/0616 285/341
6,219,007 B1 * 4/2001 Kline ..... H01Q 1/24 343/702
2006/0273980 A1 * 12/2006 Chan ..... H01Q 1/40 343/702

FOREIGN PATENT DOCUMENTS

CN 1845383 B * 5/2010 ..... H01R 13/5208
CN 205453070 U * 8/2016
CN 207910047 U * 9/2018
CN 109755814 A * 5/2019
CN 210723510 U * 6/2020
CN 210926478 U * 7/2020
TW M305969 U 2/2007

* cited by examiner

*Primary Examiner* — Dameon E Levi
*Assistant Examiner* — Anh N Ho
(74) *Attorney, Agent, or Firm* — McClure, Qualey & Rodack, LLP

(57) ABSTRACT

A bendable antenna is provided. The bendable antenna is adapted to connect a cable. The bendable antenna includes an antenna body, a connection base, a first pivot base, a second pivot base, a first elastic element and a first restriction structure. The connection base is connected to the antenna body. The first pivot base is connected to the connection base, wherein the first pivot base includes a first recess. The second pivot base pivots on the first pivot base. The first elastic element is disposed in the first recess of the first pivot base, wherein the first elastic element is telescoped on the cable. The first restriction structure is connected to the connection base, wherein the first restriction structure pushes the first elastic element to restrict the first elastic element in the first recess.

8 Claims, 11 Drawing Sheets

A2

A3

A5

WIRELESS TRANSMISSION DEVICE AND BENDABLE ANTENNA THEREOF

CROSS REFERENCE TO RELATED APPLICATIONS

This Application claims priority of Taiwan Patent Application No. 109118265, filed on Jun. 1, 2020, the entirety of which is incorporated by reference herein.

BACKGROUND OF THE INVENTION

Field of the Invention

The present invention relates to a bendable antenna, and in particular to a well-sealed bendable antenna.

Description of the Related Art

A conventional bendable antenna utilizes a rubber sheath to provide waterproofing. However, after the bendable antenna has repeatedly been bent, the rubber sheath may become loosened and the waterproofing is no longer effective. Additionally, the cable connected to the bendable antenna moves relative to the bendable antenna due to the repeated bending and pulling. The reliability and the lifespan of the bendable antenna is therefore compromised.

BRIEF SUMMARY OF THE INVENTION

Embodiments of the invention are provided to address the aforementioned difficulty.

In one embodiment, a bendable antenna is provided. The bendable antenna is adapted to connect a cable. The bendable antenna includes an antenna body, a connection base, a first pivot base, a second pivot base, a first elastic element and a first restriction structure. The connection base is connected to the antenna body. The first pivot base is connected to the connection base, wherein the first pivot base comprises a first recess. The second pivot base pivots on the first pivot base. The first elastic element is disposed in the first recess of the first pivot base, wherein the first elastic element is telescoped on the cable. The first restriction structure is connected to the connection base, wherein the first restriction structure pushes the first elastic element to restrict the first elastic element in the first recess.

In another embodiment, a wireless transmission device is provided. The wireless transmission device includes a device body, a connector, a cable and a bendable antenna. The connector is connected to the device body. The bendable antenna includes an antenna body, a connection base, a first pivot base, a second pivot base, a first elastic element and a first restriction structure. The connection base is connected to the antenna body. The first pivot base is connected to the connection base, wherein the first pivot base comprises a first recess. The second pivot base pivots on the first pivot base, wherein the second pivot base is connected to the connector. The first elastic element is disposed in the first recess of the first pivot base, wherein the first elastic element is telescoped on the cable. The first restriction structure is connected to the connection base, wherein the first restriction structure pushes the first elastic element to restrict the first elastic element in the first recess.

Utilizing the bendable antenna of the embodiment of the invention, the first elastic element is sufficiently restricted in the first recess. Even the antenna being bent repeatedly, the position of the first elastic element is stable. The first elastic element provides improved waterproof and sealing effect. Additionally, the first elastic element is telescoped on the cable, the position of the cable relative to the bendable antenna is fixed (even after repeated bending), and the reliability and lifespan of the bendable antenna is increased.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
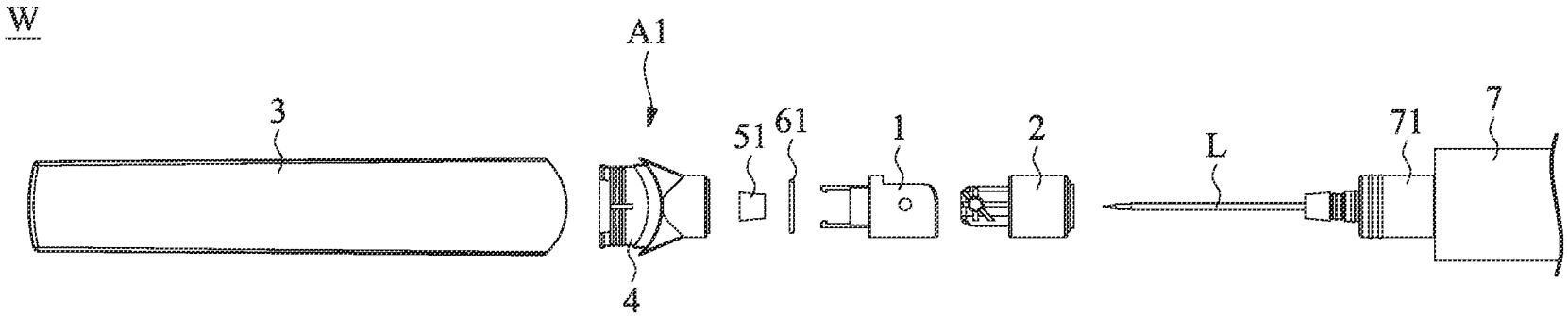
FIG. 1 is an exploded view of a bendable antenna and a device body of a first embodiment of the invention.
Figure 2:
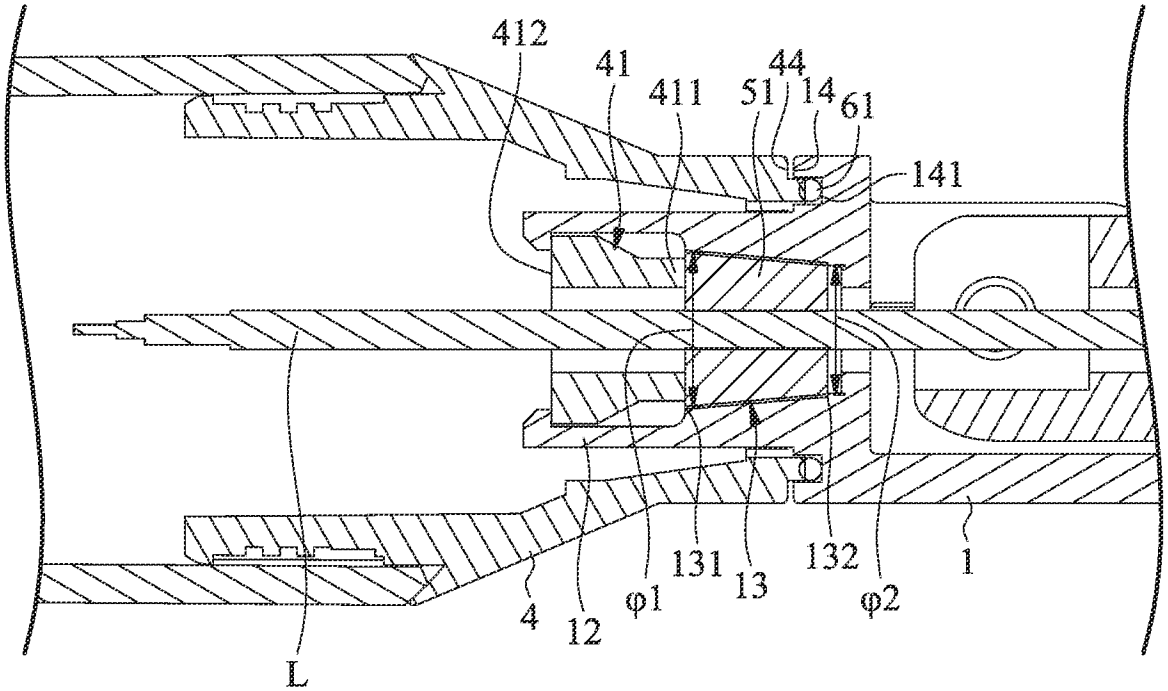
FIG. 2 is a cross sectional view of a portion of the bendable antenna of the first embodiment of the invention.

FIG. 1 is an exploded view of a bendable antenna A1 and a device body 7 of a first embodiment of the invention. FIG. 2 is a cross sectional view of a portion of the bendable antenna of the first embodiment of the invention. With reference to FIGS. 1 and 2, the bendable antenna A1 of the first embodiment of the invention is adapted to connect a cable L. The bendable antenna A1 includes an antenna body 3, a connection base 4, a first pivot base 1, a second pivot base 2, a first elastic element 51 and a first restriction structure 41. The connection base 4 is connected to the antenna body 3. The first pivot base 1 is connected to the connection base 4. The first pivot base 1 comprises a first recess 13. The second pivot base 2 pivots on the first pivot base 1. The first elastic element 51 is disposed in the first recess 13 of the first pivot base 1. The first elastic element 51 is telescoped on the cable L. The first restriction structure 41 is connected to the connection base 4. The first restriction structure 41 pushes the first elastic element 51 to restrict the first elastic element 51 in the first recess 13.

With reference to FIG. 2, in one embodiment, the first recess 13 comprises a first open end 131 and a second open end 132. The first open end 131 faces the connection base 4. The second open end 132 faces the second pivot base 2. The first open end 131 has a first end diameter φ1. The second open end 132 has a second end diameter φ2. The first end diameter φ1 is greater than the second end diameter φ2. The first elastic element 51 is cone-shaped. Therefore, when the bendable antenna A1 is bent repeatedly, the first elastic element 51 is sufficiently embedded into the first recess 13. The first elastic element 51 is prevented from becoming separated from the first recess 13.

Figure 3:
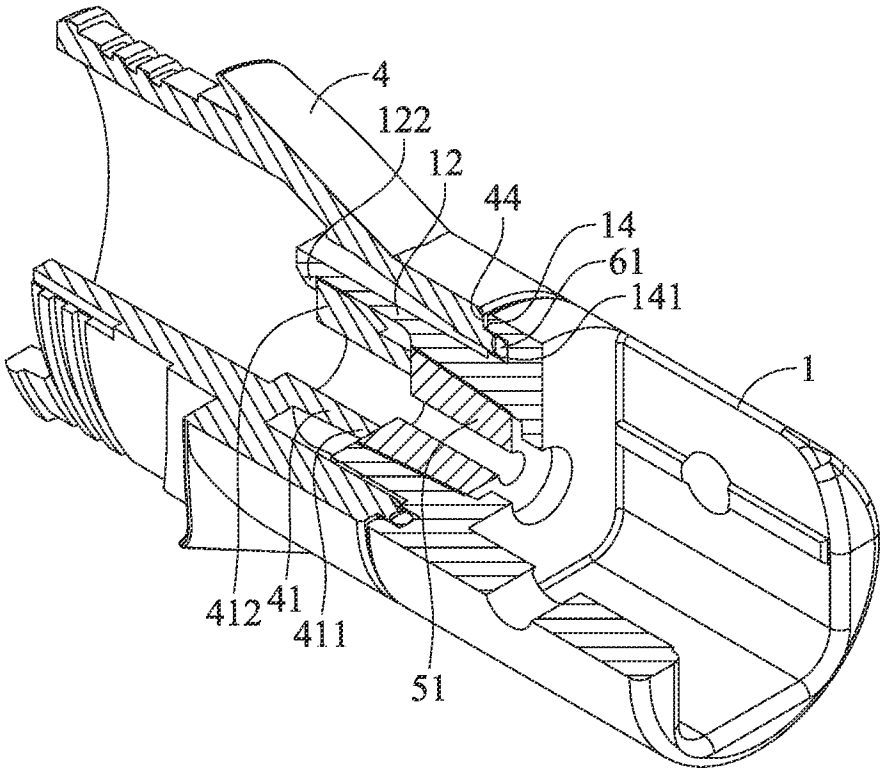
FIG. 3 shows the details of the connection base of the first embodiment of the invention.

FIG. 3 shows the details of the connection base 4 of the first embodiment of the invention. With reference to FIGS. 2 and 3, in one embodiment, the first restriction structure 41 is integrally formed on the connection base 4. The first restriction structure 41 comprises a pushing end 411, and the pushing end 411 pushes the first elastic element 51.

Figure 4B:
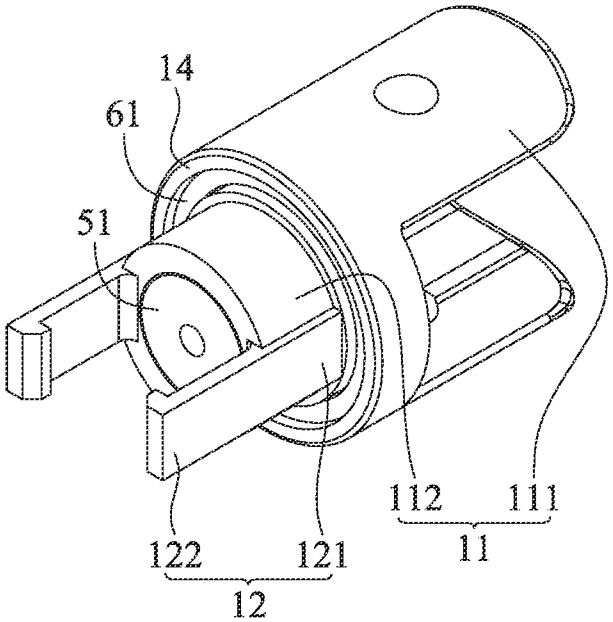
FIGS. 4A and 4B show the details of the first pivot base and the first elastic element of the first embodiment of the invention.
Figure 4A:
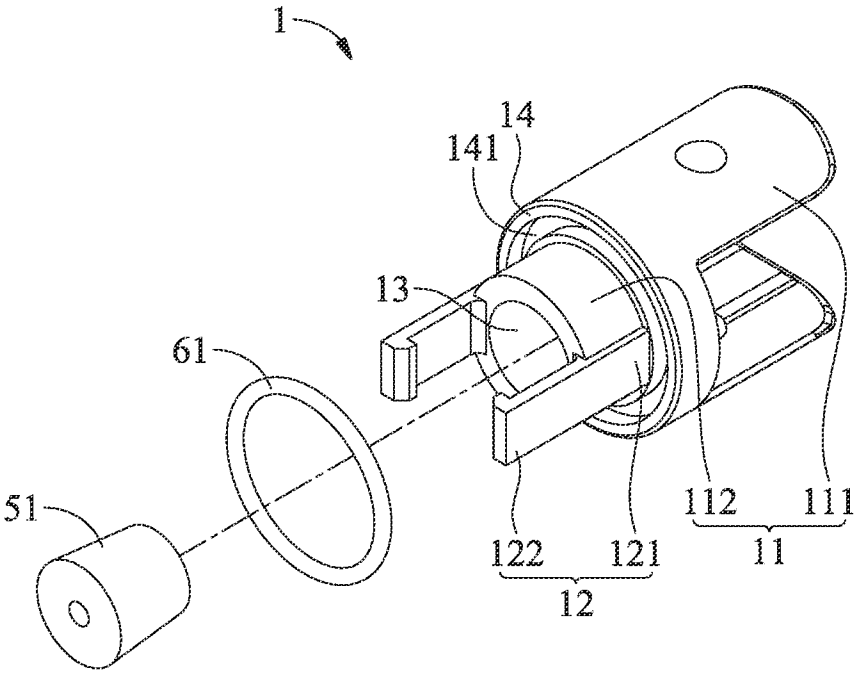

FIGS. 4A and 4B show the details of the first pivot base and the first elastic element of the first embodiment of the invention. With reference to FIGS. 2, 3, 4A and 4B, in one embodiment, the first pivot base 1 comprises a pivot base body 11 and a hook 12. A fixed end 121 of the hook 12 is affixed to the pivot base body 11. The first restriction structure 41 comprises an abutting end 412. The wedging end 122 of the hook 12 is wedged into the abutting end 412 of the first restriction structure 41, and the abutting end 412 is opposite the pushing end 411.

With reference to FIGS. 2, 4A and 4B, in one embodiment, the pivot base body 11 comprises a pivot section 111 and a cup-shaped section 112. The cup-shaped section 112 is connected to the pivot section 111. The pivot section 111 pivots on the second pivot base 2. The first recess 13 is formed on the cup-shaped section 112, and the fixed end 121 of the hook 12 is affixed to the cup-shaped section 112.

Utilizing the bendable antenna of the embodiment of the invention, the first elastic element is sufficiently restricted in the first recess. Even the antenna being bent repeatedly, the position of the first elastic element is stable. The first elastic element provides improved waterproof and sealing effect. Additionally, the first elastic element is telescoped on the cable, the position of the cable relative to the bendable antenna is fixed (even after repeated bending), and the reliability and lifespan of the bendable antenna is increased.

With reference to FIGS. 2, 3, 4A and 4B, in one embodiment, the bendable antenna further comprises a waterproof ring 61. The waterproof ring 61 is disposed between the connection base 4 and the first pivot base 1.

With reference to FIGS. 2, 4A and 4B, in one embodiment, the connection base 4 comprises a connection base joint surface 44, and the first pivot base 1 comprises a pivot base joint surface 14. The pivot base joint surface 14 is adapted to connect the connection base joint surface 44. The pivot base joint surface 14 has an annular groove 141. The waterproof ring 61 is disposed in the annular groove 141. Utilizing the waterproof ring 61, the connection base joint surface 44 and the pivot base joint surface 14, the waterproof ability of the bendable antenna is further improved.

Figure 5B:
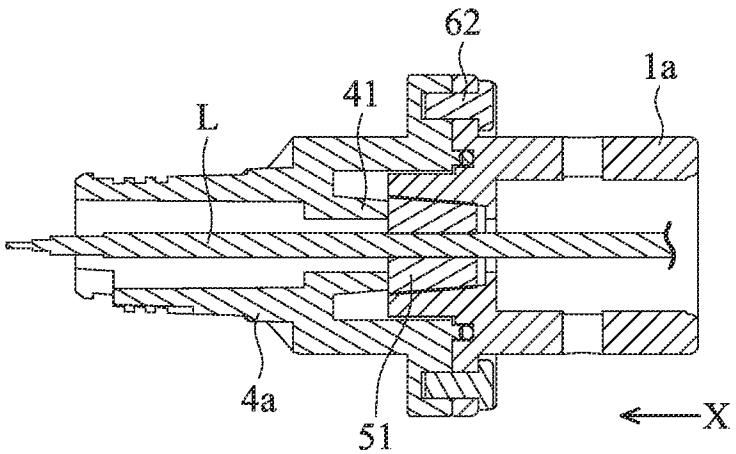
FIG. 5B is a cross sectional view of a portion of the bendable antenna of the second embodiment of the invention.
Figure 5A:
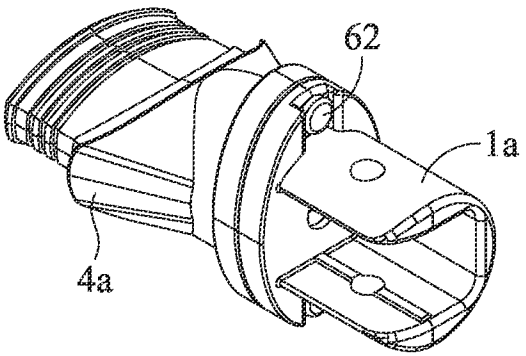
FIG. 5A is a perspective of a portion of a bendable antenna of a second embodiment of the invention.

FIG. 5A is a perspective of a portion of a bendable antenna of a second embodiment of the invention. FIG. 5B is a cross sectional view of a portion of the bendable antenna of the second embodiment of the invention. With reference to FIGS. 5A and 5B, in the second embodiment of the invention, the bendable antenna A2 further comprises a fastener 62. The fastener 62 affixes the connection base 4*a* to the first pivot base 1*a*. In one embodiment, the fastener 62 is a bolt. The fastener 62 connects the connection base 4*a* to the first pivot base 1*a* by screwing. An extending direction X of the fastener 62 is parallel to an extending direction of the cable L in the first elastic element 51. In this embodiment, the fastener 62 extends in the extending direction X, and connects the connection base 4*a* to the first pivot base 1*a* by screwing. Therefore, the first restriction structure 41 pushes the first elastic element 51.

Figure 6B:
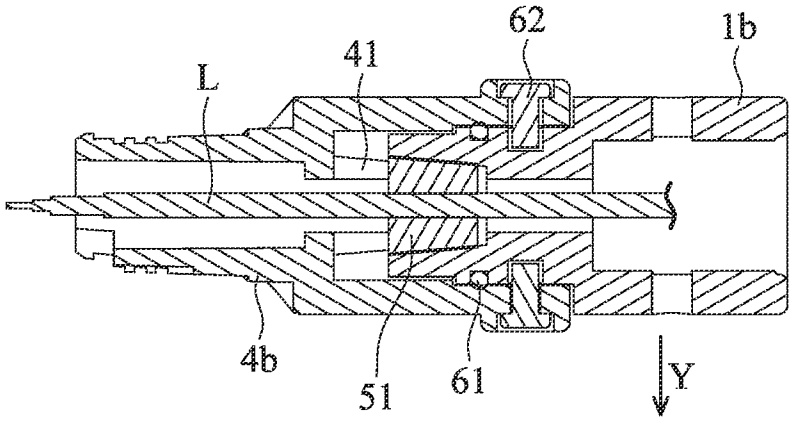
FIG. 6B is a cross sectional view of a portion of the bendable antenna of the third embodiment of the invention.
Figure 6A:
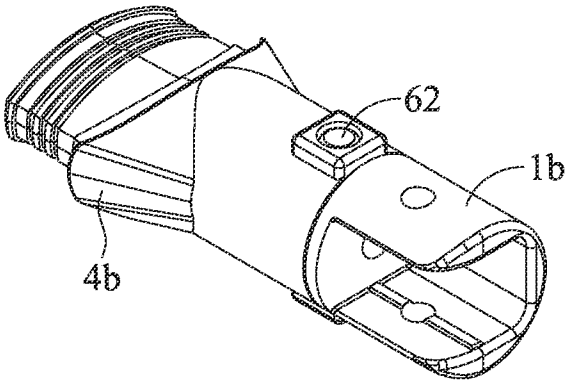
FIG. 6A is a perspective of a portion of a bendable antenna of a third embodiment of the invention.

FIG. 6A is a perspective of a portion of a bendable antenna of a third embodiment of the invention. FIG. 6B is a cross sectional view of a portion of the bendable antenna of the third embodiment of the invention. With reference to FIGS. 6A and 6B, in the third embodiment of the invention, the bendable antenna A3 further comprises a fastener 62. The fastener 62 affixes the connection base 4*b* to the first pivot base 1*b*. In one embodiment, the fastener 62 is a bolt. The fastener 62 connects the connection base 4*b* to the first pivot base 1*b* by screwing. An extending direction Y (radial direction of the bendable antenna) of the fastener 62 is perpendicular to an extending direction of the cable L in the first elastic element 51. With reference to FIG. 6B, in this embodiment, the position of the waterproof ring 61 can be modified.

Figure 7B:
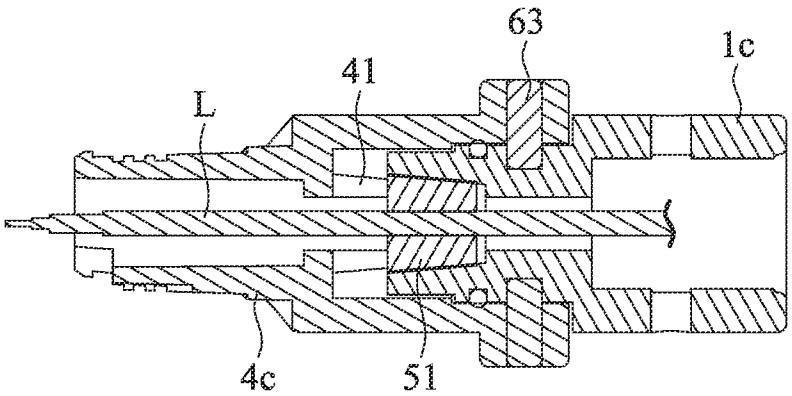
FIG. 7B is a cross sectional view of a portion of the bendable antenna of the fourth embodiment of the invention.
Figure 7A:
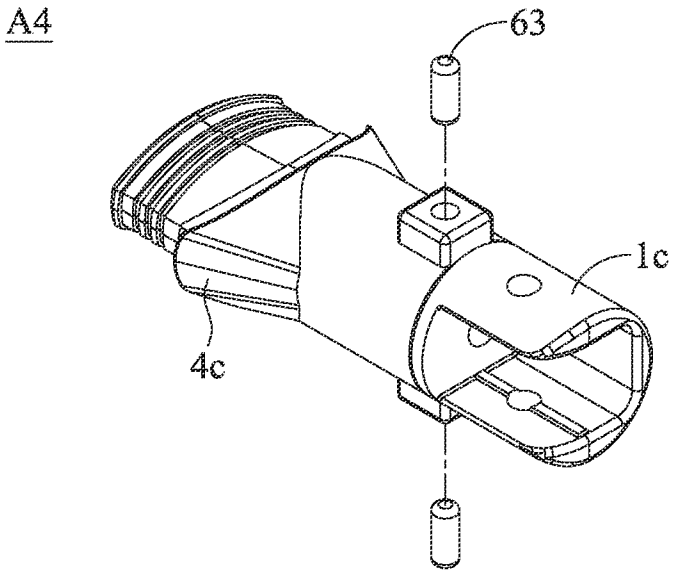
FIG. 7A is a perspective of a portion of a bendable antenna of a fourth embodiment of the invention.

FIG. 7A is a perspective of a portion of a bendable antenna of a fourth embodiment of the invention. FIG. 7B is a cross sectional view of a portion of the bendable antenna of the fourth embodiment of the invention. With reference to FIGS. 7A and 7B, in the fourth embodiment of the invention, the bendable antenna A4 further comprises a fastener 63. The fastener 63 affixes the connection base 4*c* to the first pivot base 1*c*. In one embodiment, the fastener 63 is a latch.

Figure 8B:
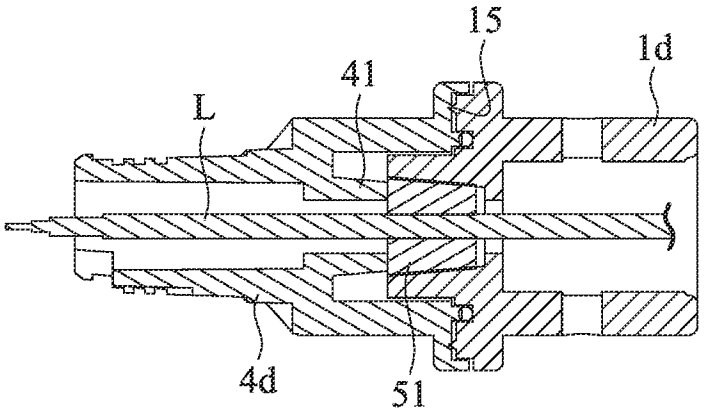
FIG. 8B is a cross sectional view of a portion of the bendable antenna of the fifth embodiment of the invention.
Figure 8A:
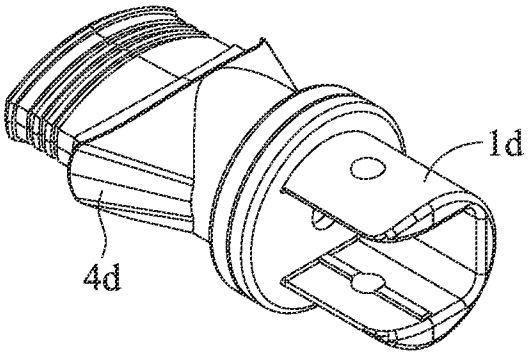
FIG. 8A is a perspective of a portion of a bendable antenna of a fifth embodiment of the invention.

FIG. 8A is a perspective of a portion of a bendable antenna of a fifth embodiment of the invention. FIG. 8B is a cross sectional view of a portion of the bendable antenna of the fifth embodiment of the invention. With reference to FIGS. 8A and 8B, in the fifth embodiment of the invention, the first pivot base 1*d* of the bendable antenna A5 includes a welding protrusion 15. The connection base 4*d* and the first pivot base 1*d* are combined by applying ultrasonic welding to the welding protrusion 15.

Figure 9A:
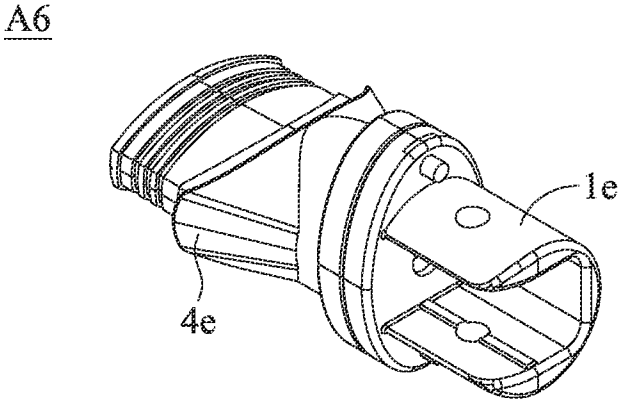
FIG. 9A is a perspective of a portion of a bendable antenna of a sixth embodiment of the invention.
Figure 9B:
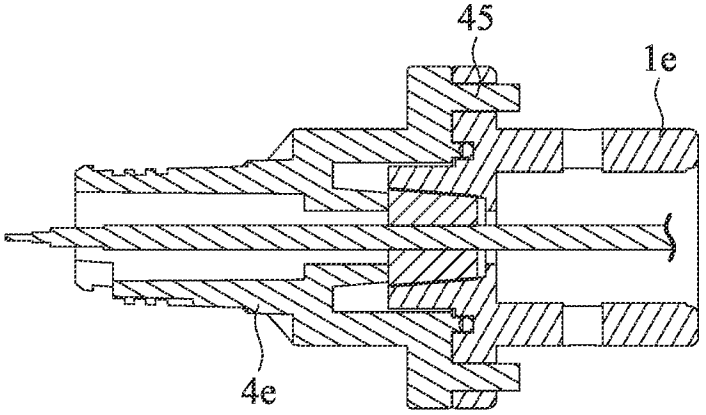
FIG. 9B is a cross sectional view of a portion of the bendable antenna of the sixth embodiment of the invention (before melting)
Figure 9C:
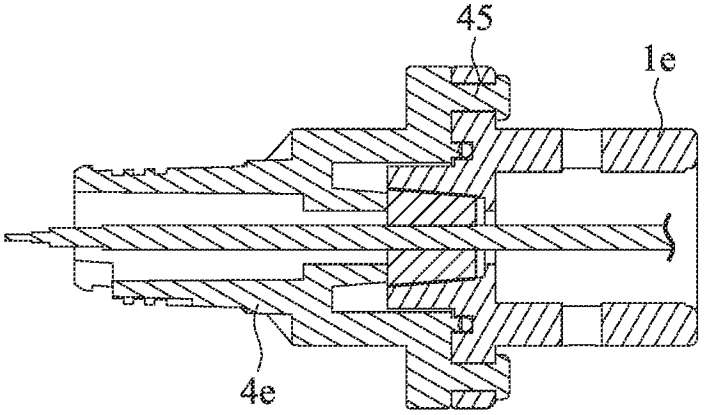
FIG. 9C is a cross sectional view of a portion of the bendable antenna of the sixth embodiment of the invention (after melting)

FIG. 9A is a perspective of a portion of a bendable antenna of a sixth embodiment of the invention. FIG. 9B is a cross sectional view of a portion of the bendable antenna of the sixth embodiment of the invention (before melting). FIG. 9C is a cross sectional view of a portion of the bendable antenna of the sixth embodiment of the invention (after melting). With reference to FIGS. 9A, 9B and 9C, in the sixth embodiment of the invention, the connection base 4*e* of the bendable antenna A6 includes a hot melt post 45. The connection base 4*e* and the first pivot base 1*e* are combined by hot-melting the hot melt post 45.

Figure 10B:
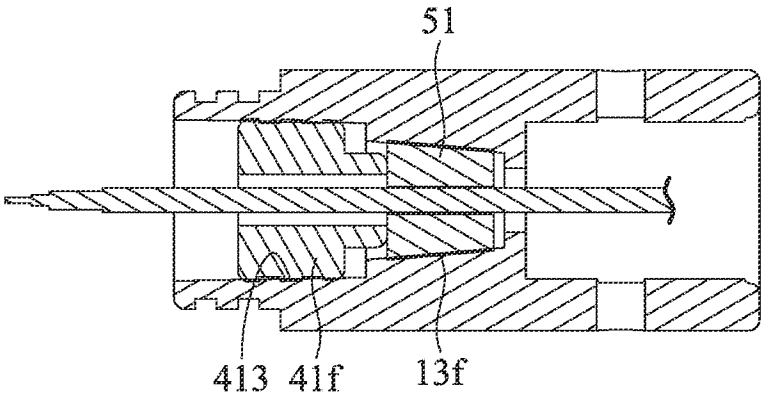
FIG. 10B is a cross sectional view of a portion of the bendable antenna of the seventh embodiment of the invention.
Figure 10A:
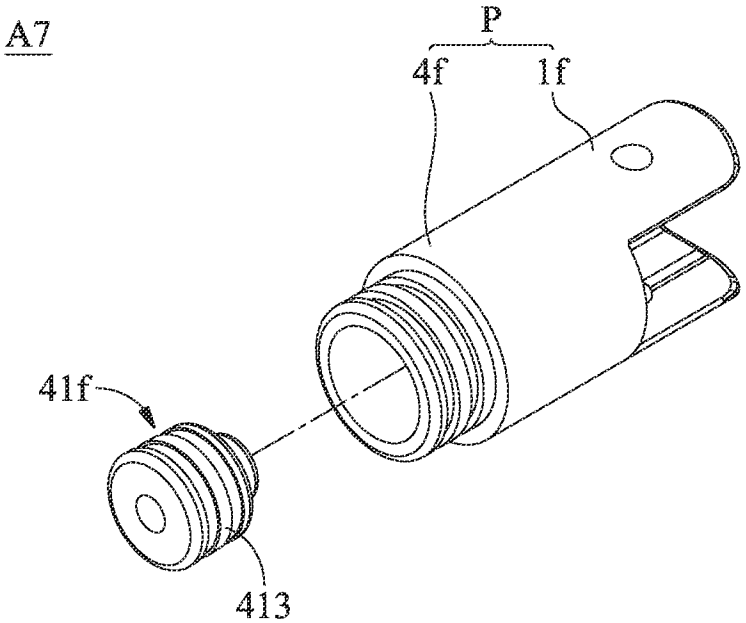
FIG. 10A is a perspective of a portion of a bendable antenna of a seventh embodiment of the invention.

FIG. 10A is a perspective of a portion of a bendable antenna of a seventh embodiment of the invention. FIG. 10B is a cross sectional view of a portion of the bendable antenna of the seventh embodiment of the invention. With reference to FIGS. 10A and 10B, in the seventh embodiment of the invention, the connection base 4*f* and the first pivot base if of the bendable antenna A7 is integrally formed as a pivot member P. The first restriction structure 41*f* is detachable connected to the connection base 4*f* (connected to the pivot member P). The first restriction structure 41*f* pushes the first elastic element 51 to restrict the first elastic element 51 in the first recess 13*f*. In one embodiment, the surface of the first restriction structure 41*f* has anti-slip ribs 413. The anti-slip ribs 413 provide anti-slip function.

Figure 11:
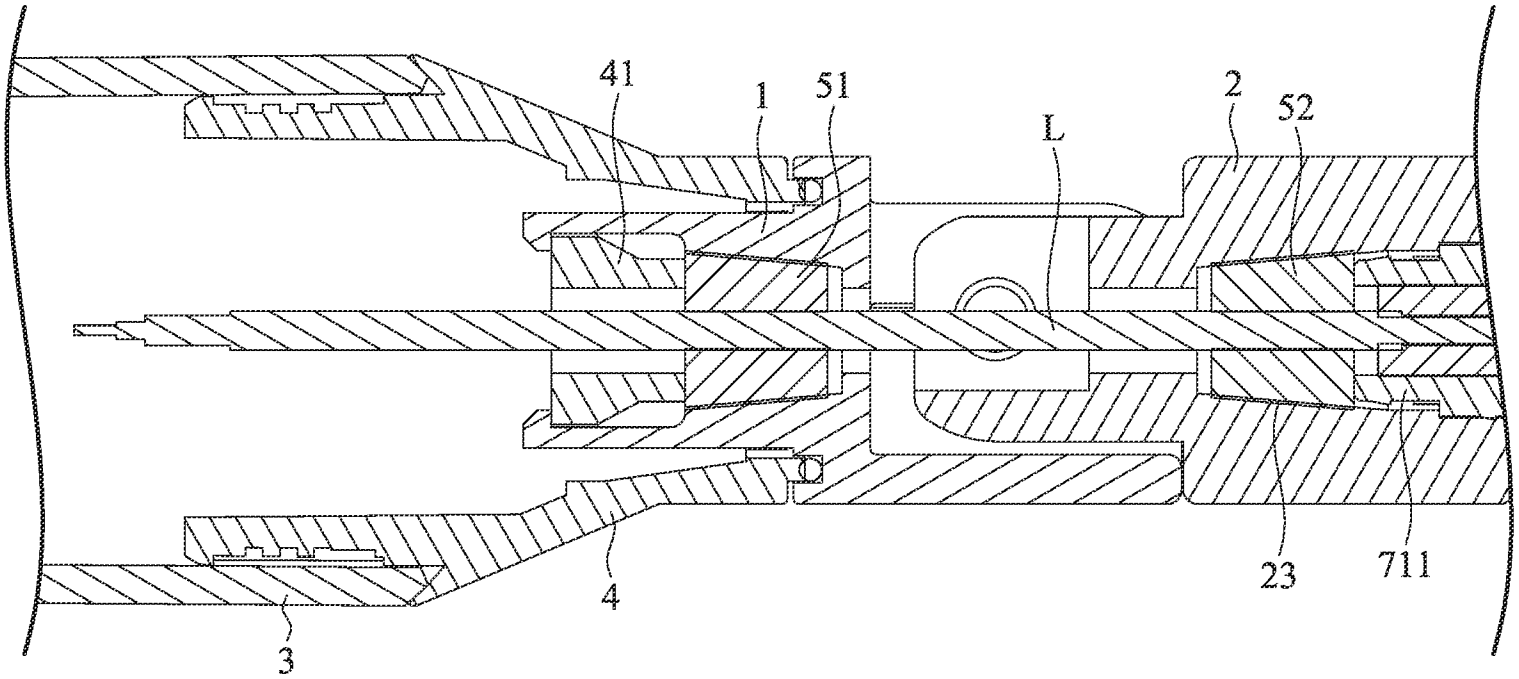
FIG. 11 is a cross sectional view of a portion of the wireless transmission device of the embodiment of the invention.

With reference to FIG. 1, in another embodiment, a wireless transmission device W is provided. The wireless transmission device W includes a device body 7, a connector 71, a cable L and a bendable antenna A1. The cable L is disposed on the bendable antenna A1. The connector 71 is disposed on the bendable antenna A1. The bendable antenna A1 and the cable L is assembled to the device body 7 via the connector 71. The bendable antenna A1 includes an antenna body 3, a connection base 4, a first pivot base 1, a second pivot base 2, a first elastic element 51 and a first restriction structure 41. The second pivot base 2 is connected to the connector 71. FIG. 11 is a cross sectional view of a portion of the wireless transmission device W of the embodiment of the invention. With reference to FIGS. 1 and 11, in one embodiment, a second elastic element 52 is telescoped on the cable L. The second pivot base 2 comprises a second recess 23. The second elastic element 52 is disposed in the second recess 23. The connector 71 comprises a second restriction structure 711. The second restriction structure 711 pushes the second elastic element 52 to restrict the second elastic element 52 in the second recess 23.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bendable antenna, adapted to connect a cable, comprising:

an antenna body;

a connection base, connected to the antenna body;

a first pivot base, connected to the connection base, wherein the first pivot base comprises a first recess;

a second pivot base, pivoting on the first pivot base;

a first elastic element, disposed in the first recess of the first pivot base, wherein the first elastic element is telescoped on the cable; and a first restriction structure, connected to the connection base, wherein the first restriction structure abuts and directly pushes the first elastic element to restrict the first elastic element in the first recess, wherein the first recess comprises a first open end and a second open end, the first open end faces the connection base, the second open end faces the second pivot base, the first open end has a first end diameter, the second open end has a second end diameter, the first end diameter is greater than the second end diameter, the first elastic element is cone-shaped, and the first elastic element is embedded into the first recess, wherein the first restriction structure is integrally formed on the connection base, the first restriction structure comprises a pushing end, and the pushing end pushes the first elastic element, wherein the first pivot base comprises a pivot base body and a hook, a fixed end of the hook is affixed to the pivot base body, the first restriction structure comprises an abutting end, a wedging end of the hook is wedged against the abutting end of the first restriction structure, and the abutting end is opposite the pushing end.

2. The bendable antenna as claimed in claim 1, wherein the pivot base body comprises a pivot section and a cup-shaped section, the cup-shaped section is connected to the pivot section, the pivot section pivots on the second pivot base, the first recess is formed on the cup-shaped section, and the fixed end of the hook is affixed to the cup-shaped section.

3. The bendable antenna as claimed in claim 1, further comprising a waterproof ring, wherein the waterproof ring is disposed between the connection base and the first pivot base.

4. The bendable antenna as claimed in claim 3, wherein the connection base comprises a connection base joint surface, the first pivot base comprises a pivot base joint surface, the pivot base joint surface is adapted to connect the connection base joint surface, the pivot base joint surface has an annular groove, and the waterproof ring is disposed in the annular groove.

5. A wireless transmission device, comprising:

a device body;

a connector, connected to the device body;

a cable; and a bendable antenna, comprising:

an antenna body;

a connection base, connected to the antenna body;

a first pivot base, connected to the connection base, wherein the first pivot base comprises a first recess;

a second pivot base, pivoting on the first pivot base, wherein the second pivot base is connected to the connector;

a first elastic element, disposed in the first recess of the first pivot base, wherein the first elastic element is telescoped on the cable; and a first restriction structure, connected to the connection base, wherein the first restriction structure abuts and directly pushes the first elastic element to restrict the first elastic element in the first recess, wherein the first recess comprises a first open end and a second open end, the first open end faces the connection base, the second open end faces the second pivot base, the first open end has a first end diameter, the second open end has a second end diameter, the first end diameter is greater than the second end diameter, the first elastic element is cone-shaped, and the first elastic element is embedded into the first recess, wherein the first restriction structure is integrally formed on the connection base, the first restriction structure comprises a pushing end, and the pushing end pushes the first elastic element, wherein the first pivot base comprises a pivot base body and a hook, a fixed end of the hook is affixed to the pivot base body, the first restriction structure comprises an abutting end, the wedging end of the hook is wedged against the abutting end of the first restriction structure, and the abutting end is opposite the pushing end.

6. The wireless transmission device as claimed in claim 5, wherein the pivot base body comprises a pivot section and a cup-shaped section, the cup-shaped section is connected to the pivot section, the pivot section pivots on the second pivot base, the first recess is formed on the cup-shaped section, and the fixed end of the hook is affixed to the cup-shaped section.

7. The wireless transmission device as claimed in claim 5, further comprising a waterproof ring, wherein the waterproof ring is disposed between the connection base and the first pivot base.

8. A wireless transmission device, comprising:

a device body;

a connector, connected to the device body;

a cable; and a bendable antenna, comprising:

an antenna body;

a connection base, connected to the antenna body;

a first pivot base, connected to the connection base, wherein the first pivot base comprises a first recess;

a second pivot base, pivoting on the first pivot base, wherein the second pivot base is connected to the connector;

a first elastic element, disposed in the first recess of the first pivot base, wherein the first elastic element is telescoped on the cable;

a first restriction structure, connected to the connection base, wherein the first restriction structure pushes the first elastic element to restrict the first elastic element in the first recess, wherein the first recess comprises a first open end and a second open end, the first open end faces the connection base, the second open end faces the second pivot base, the first open end has a first end diameter, the second open end has a second end diameter, the first end diameter is greater than the second end diameter, the first elastic element is cone-shaped, and the first elastic element is embedded into the first recess, wherein the first restriction structure is integrally formed on the connection base, the first restriction structure comprises a pushing end, and the pushing end pushes the first elastic element; and a second elastic element, wherein the second elastic element is telescoped on the cable, the second pivot base comprises a second recess, the second elastic element is disposed in the second recess, the connector comprises a second restriction structure, and the second restriction structure pushes the second elastic element to restrict the second elastic element in the second recess.

* * * * *